United States Patent [19]

McMillin et al.

[11] 4,167,250

[45] Sep. 11, 1979

[54] SEQUENTIAL VELOCITY DISK REFINER

[75] Inventors: Charles W. McMillin; Peter Koch, both of Alexandria, La.

[73] Assignee: The United States of America as represented by the Secretary of Agriculture, Washington, D.C.

[21] Appl. No.: 897,811

[22] Filed: Apr. 19, 1978

[51] Int. Cl.[2] ..... B02C 7/06; B02C 7/12

[52] U.S. Cl. ..... 241/251; 241/247; 241/259.1

[58] Field of Search ..... 241/188 A, 244, 247, 241/250, 251, 252, 259.1, 260, 261.2, 261.3

[56] References Cited

U.S. PATENT DOCUMENTS

| | | | |
|---|---|---|---|
| 1,269,399 | 6/1918 | Davis | 241/252 X |
| 1,970,330 | 8/1934 | Mason | 241/251 X |
| 3,659,793 | 5/1972 | Stephenson et al. | 241/188 A X |
| 3,845,909 | 11/1974 | Johansson | 241/247 X |
| 4,090,672 | 5/1978 | Ahrec | 241/261.3 X |

*Primary Examiner*—Howard N. Goldberg
*Attorney, Agent, or Firm*—M. Howard Silverstein; David G. McConnell

[57] ABSTRACT

A counter-rotating disk type pulping apparatus is modified to yield paper products of improved properties. Each of the two facing counter-rotating disks is modified so as to comprise a plurality of concentric rotatable rings which are driven at increasing rotational velocities from the innermost ring outward.

5 Claims, 3 Drawing Figures

SEQUENTIAL VELOCITY DISK REFINER

BACKGROUND OF THE INVENTION (1) Field of the Invention

The invention relates to a modification of a standard double-disk refiner used to mechanically pulp wood to fiberous form for subsequent production of paper products.

(2) Description of the Prior Art

Conventional disk refiners used for production of mechanical pulp are of two general types-single an double rotating disks. (Gavelin, N. G. 1966. Science and Technology of Mechanical Pulp Manufacture. Lockwood Publishing Co., Inc., New York, N.Y.).

In a double-disk refiner, two solid disks are rotated at constant speed in opposite directions on separate horizontal shafts. The speed of rotation varies from about 1500 rpm to 1800 rpm. Total installed horsepower on each shaft may be as great as 5000 and the diameter of disks may be as large as 52 inches. Woody material to be pulped in the form of wood chips or fiber is fed to the center of the disks via a screw conveyor. The refining zone may or may not be steam pressurized. Each refining disk contains a number of cast alloy plates which form the refining surface. A pattern, usually consisting of a series of bars and grooves, are cast into the surface of the plate to effect varying degrees of refining action.

In the mechanical pulping process, whole green wood bolts are first reduced to chips about 1-inch along the grain. (Sawdust, planer shavings, and other waste material may also be used, but green wood is preferred.) The chips are then washed to remove dirt and other undesirable materials. From the chip washer, chips may be processed directly in a first stage refiner or may go to a screw-press for initial disintegration, heating, pitch removal, and sometimes mild chemical impregnation. First stage refining may be followed by either one or two additional refining stages prior to screening for removal of oversize particles, bleaching, and sheet formation.

SUMMARY OF THE INVENTION

The object of the invention is to create greater torsional stress in wood fibers and hence produce a higher proportion of ribbon-like, fibrillated particles in the resulting pulp which will ultimately yield paper products of high strength and other desirable characteristics.

To accomplish the above object a double-disk refining apparatus having counter-rotating disks was improved in a manner such that each disk comprises a plurality of concentric rotatable rings, the rings being attached to rotating means for independently rotating the rings at increasing rotational velocities from the innermost ring outward.

DESCRIPTION OF THE PREFERRED EMBODIMENTS

Figure 1:
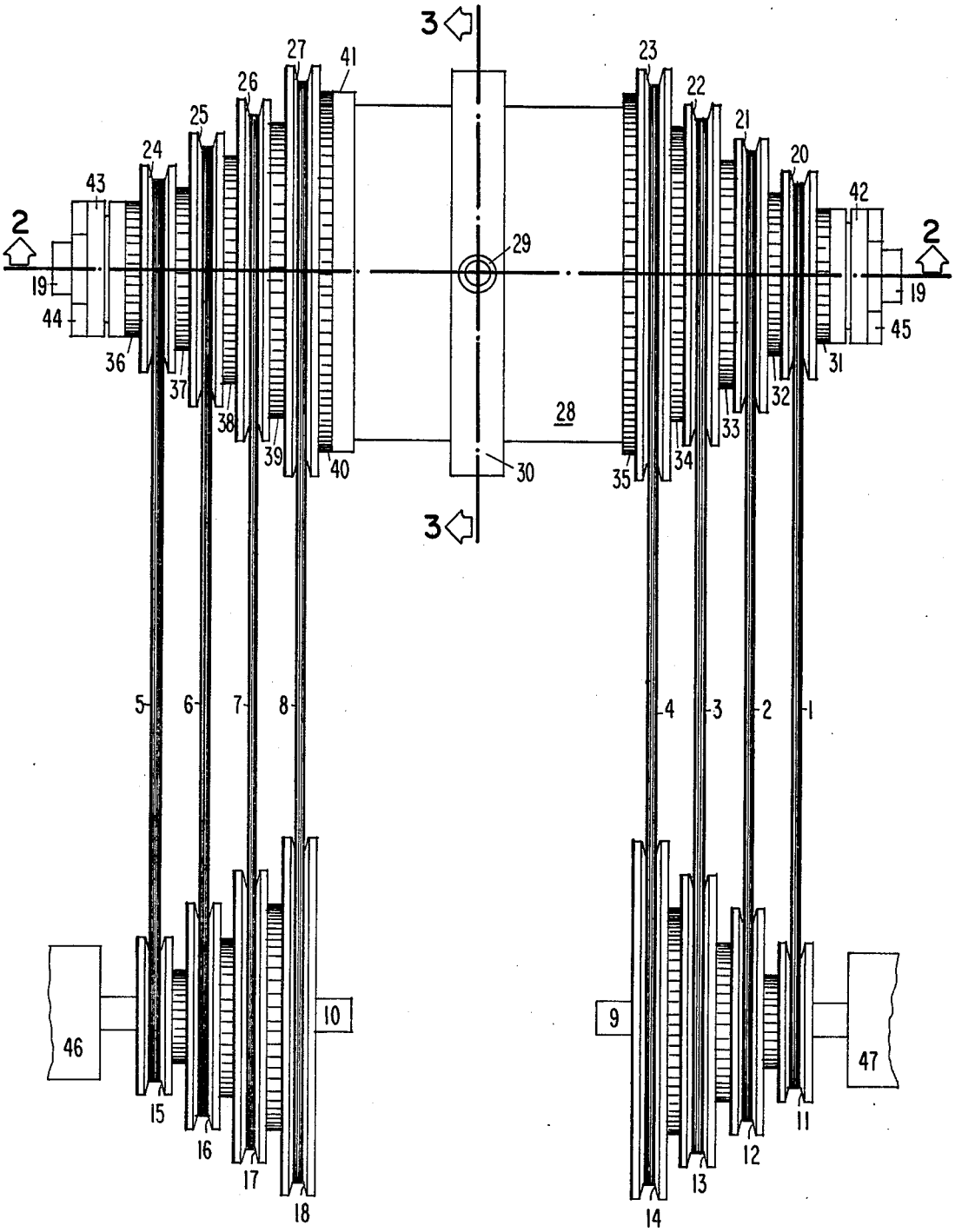
FIG. 1 is a plan view of the sequential velocity disk refiner and drive means.

FIG. 1 shows one embodiment of a double-disk refiner and its drive mechanism which has been modified in accordance with the invention.

Drive motors 46 and 47, shafts 9 and 10, drive pulleys 11–18 and belts 1–8 constitute a belt driven means for driving rotating means pulleys 20–27 at rotational velocities that increase sequentially from rotating means pulleys 20 through 23 and from rotating means pulleys 24 through 27. In other words, rotating means pulleys 20 and 24 are driven at the lowest number of revolutions per minute (RPM) and rotating means pulleys 23 and 27 are driven at the highest number of RPM. The belt driven drive means is not considered to be part of the invention. Rotating means 20 through 27 can be individually driven by any compatible means known to the art (i.e., friction drive, chain drive, direct drive, etc.) and can be mechanisms other than pulleys.

In the embodiment shown in FIG. 1, drive pulleys 11 through 14 are fixed to shaft 9, and drive pulleys 15 through 18 are fixed to shaft 10. In order for concentric rotatable rings (or nested cylinders) 48 through 55 (FIG. 2) which are attached to rotating means pulleys 20 through 27 to be driven at sequential increasing rotational velocities, it is necessary to vary the ratios of the pulley diameters in each set of pulleys (i.e., 11 to 20, 12 to 21, 13 to 22, 14 to 23, etc.). The overall rotational speed of the driven means pulley set 20 through 23 and driven means pulley set 24 through 27 can be varied by selection of motors 46 and 47 or by other mechanical means as can the rotational direction of the refining surfaces formed by the ends of the concentric rotatable rings (or nested cylinders) 48 through 55 (FIG. 2).

Figure 2:
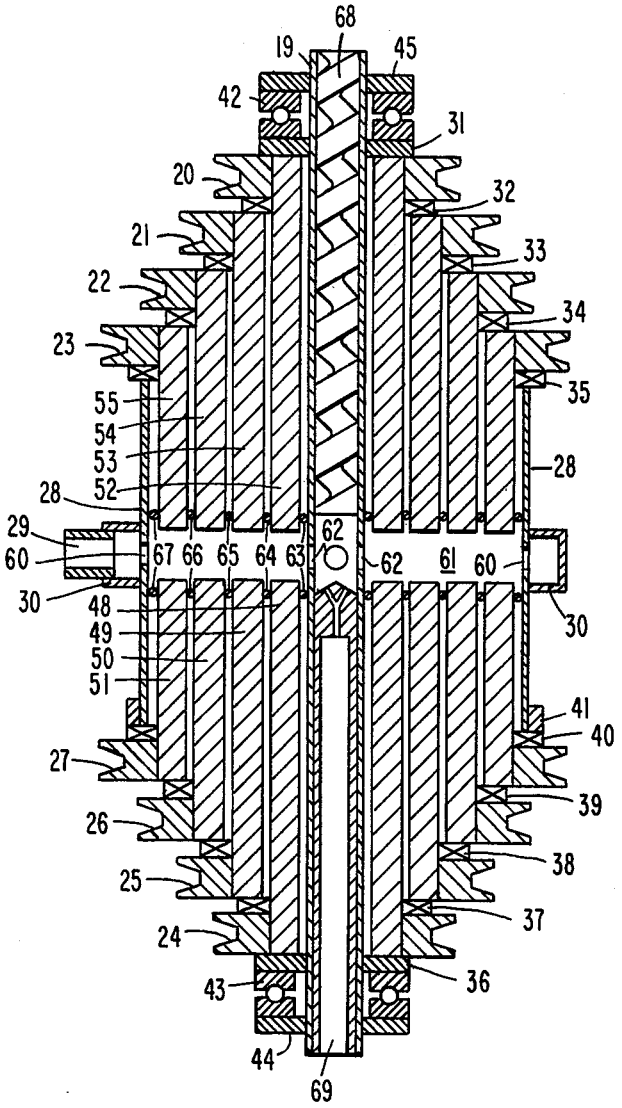
FIG. 2 is a section view of the sequential velocity disk refiner taken along line 2—2 in FIG. 1.

FIG. 2 shows two opposing sets of concentric rotatable rings (or nested rotatable cylinders) 48, 49, 50, 51 and 52, 53, 54, 55. The end of each set of concentric rings (or nested cylinders) opposite the sets of pulleys defines refining surfaces which are comparable to the refining surfaces of the rotating-disks in a conventional disk refining apparatus (see also FIG. 3). Each ring (or cylinder) is attached at the end opposite the refining surface end to one of the rotating means pulleys 20 through 27.

Innermost rings 48 and 52 (with rotating means pulleys 20 and 24 respectively attached thereon) are rotatably mounted about common shaft 19. Each sequentially larger ring (with proper rotating means attached) is rotatably mounted about the next smaller ring (i.e., 53 on 52, 54 on 53, and 55 on 54; 49 on 48, 50 on 49 and 51 on 50) with suitable bearing surface provided between each. In the embodiment depicted in FIG. 2 bearing surfaces are provided for rotating means pulleys 20 through 27 by bearings 32 through 34 and 37 through 39. When concentric rings (or nested cylinders) 48 through 52 and bearings 32 through 34 and 37 through 39 are in place, bearings 35 and 40 are seated against outer retaining ring 28. Ball bearings 42 and 43 are seated against thrust bearings 31 and 36 respectively and the entire assembly is held in place by nuts 44 and 45 on each end of common shaft 19.

The assembly can also include a means for adjusting the clearance between the opposing refining surfaces (i.e., refining zone 61). This can be accomplished by having a threaded portion on one end of outer housing 28 on which is mounted a large nut 41 that contacts bearing 40. Loosening or tightening nut 41 and nut 44 allows axial adjustment of refining zone 61. Preferably clearance between refiner surfaces are from about 0.005 to 0.020 inches depending on the material being processed.

Figure 3:
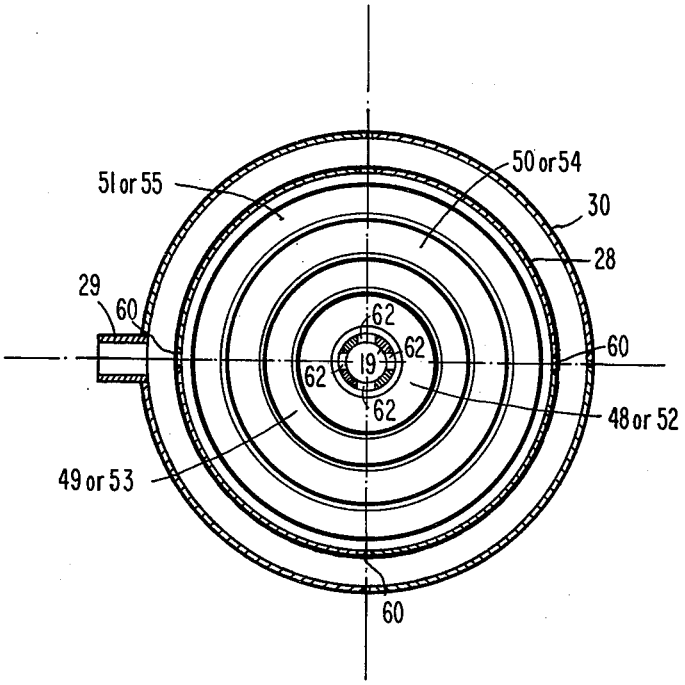
FIG. 3 is a section view of the sequential velocity disk refiner taken along line 3—3 in FIG. 1.

Common shaft 19 is hollow and contains at one end screw 68 for feeding unrefined or raw pulp to refining zone 61 through a plurality of holes 62 in the walls of shaft 19. Refining zone 61 is defined as the area between the refining surfaces of the two opposing sets of rotatable rings (or nested cylinders). The other end of hollow shaft 19 contains means 69 for bringing in dilution water or steam to be mixed with the raw fiber. Referring to FIGS. 2 and 3 it can be seen that retaining ring 28 contains a plurality of holes 60 contiguous to refining zone 61 to allow exit of the refined pulp into collection ring 30 which is a hollow ring attached to retaining ring 28. Retaining ring outlet 29 allows for the ultimate collection of refined pulp.

The entire refiner assembly is sealed wth O-rings 63 through 67 so that raw fiber may be fed to refining zone 61 at elevated pressures.

The preferred method for use with the sequential velocity refining apparatus is embraced within the inventor's own unintegrated (relative to pulpwood processing) investigations. Specifically, these investigations included studies of the effects of gross wood characteristics (McMillin TAPPI 51, 1, pp. 51–56, 1968; Wood Sci. and Tech. 3, pp. 232–238, 1969; and Wood Sci. and Tech. 3, pp. 287–300, 1969), the microscopically fine structural characteristics of wood (McMillin, Wood Sci. and Tech. 3, pp. 139–149, 1969), and scanning electron microscope studies of the torsional stress failure patterns of individual wood fibers (McMillin, Svensk Papperstidning 9, pp. 319–324, 1974, and McMillin et al., Wood Sci. 6, pp. 272–277, 1974).

A method was developed from the above studies for the production of high strength pulp using selected wood materials from southern pine and other wood species exhibiting the proper characteristics. Commercial refiner trials with southern pine typically yield a paper of relatively low strength and require high energy input. The low strength of mechanical pulps from southern pine is in part caused by a deficiency of bonding potential.

As a general proposition, using loblolly pine as an example, pulp fiber mechanically refined from wood having long, narrow diameter tracheids with thick walls (based on a weighted earlywoolatewood composite average) will yield a paper of improved burst, breaking length, and sheet density.

The use of high refining energy and the employment of fast grown wood that contains a high proportion of latewood (i.e., wood most distant from the pitch) but of relatively low density will yield a paper that exhibits the same improved strength properties.

The microscopically fine structure characteristics of wood that combine to produce a tree, give rise to a fibril helix twist in the secondary wall ($S_2$ layer) in a specific direction (i.e., Z twist or S twist) for certain species of trees. in the case of *Pinus taeda L.*, for example, the $S_2$ layer helix is in the Z direction in longitudinal tracheids.

In initial step of the preferred process calls for the selection of trees based upon the characteristic of fibril helix twist direction in the $S_2$ layer of the secondary wall of longitudinal fibers. Trees with the Z direction helix twist or alternatively trees with the S direction helix twist are to be selected. The selection is entirely practical and is made on the basis of the known wood fiber morphological characteristics of various tree species. The process involves also several steps wherein the selection of a certain particularly desirable material is made. Although all of the selections required by the process have as their initial basis the somewhat exotic studies of wood fiber morphology, the necessarily more practical process material choices are made from quite mundane considerations (i.e., tree growth rate, wood location with respect to pith, wood specific gravity, etc.).

The choice of material restrictions related to wood location within the stem and related to specific gravity and to growth rate is devised to insure an ultimate wood pulp for the production of paper that will exhibit the composition and properties essential for developing superior strength characteristics in the finished paper.

The desired type of tracheid predominates in wood that is (a) fast growing, (b) located beyond the core, i.e., about the tenth annual growth ring from the pith, and (c) of relatively low specific gravity.

The selection and segregation of material that produces and reserves wood from a specific stem location and is of a specific density and growth rate within the bolt is based also upon a number of factors related to wood fiber morphology. It has been established that a paper pulp containing preponderant amounts of a particular type of wood tracheid, namely those tracheids that are long, or narrow diameter, and with thick walls, will yield a finished paper with superior properties.

It was established experimentally that handsheets produced from specific samples of fast-grown wood containing a high proportion of latewood, and also wood of relatively low specific gravity produced finished paper of improved strength. Such samples were obtained from rectangular cants (i.e., portions of the tree trunk) containing the pith in the center portion and by a further sawing pattern cant portions that resulted in boards containing a known number of annual rings from the pith. Because of the natural variability of southern pine, it was possible to further select boards of each annual ring class that were of high or low specific gravity and were originally produced via a slow or fast growth rate.

The latewood content of loblolly pine characteristically increases with increasing distance of wood location from the center of the pith of the log. For example, corewood (0–10 rings from center) exhibits about 26% of latewood, middle wood (10–20 growth rings from center) will contain about 34% latewood, and outerwood (20 or more growth rings) shows about 38% latewood. Accordingly, wood inward from the outer cylindrical surface to not less than the tenth growth ring of the step is preferably selected.

A relationship exists between wood specific gravity and the strength properties of the finished paper. Wood of relatively low specific gravity will produce a finished paper with superior strength properties. This relationship justifies the material separation and segregation step of the claimed process that is based on wood specific gravity. The specific gravity based separation of wood or wood chips can be effected efficiently by visual inspection, by use of radiation techniques, or by flotation in fluids (gas or liquid).

A relationship also exists between the growth rate (i.e., the number of annual rings per radial inch of the cross-section of the step) and the strength properties of the finished paper. Wood of fast growth rate (about six annual rings per inch or less) will produce a finished paper with superior strength properties. This relationship justifies the material separation step of the process that is based on the rate of growth of wood. The rate of growth based separation can be effected efficiently by visual inspection of the felled tree or by electronic scanning of the cross-sectional surface.

The preferred process makes use of some important mechanical operations: 1. A wood reduction operation wherein the wood is removed sequentially inward from the peripheral cylindrical surface of the stem. 2. A mechanical pulping operation that employs a refining apparatus that is operated so as to take advantage of the torsional stress failure pattern of wood fibers being refined. The technologies for the first operation are known in woodworking operations but presently not utilized for selection of wood having desirable papermaking properties. For example, the specified reduction operation can remove wood peripherally inward from the outer cylindrical surface of the bolt to a location not deeper than about the tenth growth ring from the pith by use of a shaping-lathe headrig, a chipping headrig, a veneer lathe, or by slabbing with conventional saws. The selected wood thus removed is reserved for the subsequent refining operations.

The second mechanical operation that concerns the refining of wood fibers involves the use of an apparatus that operates so as to exploit the torsional stress failure pattern of the wood fibers being refined.

The mechanical pulping operation according to one step of the process makes it desirable that the helix twist direction of the fibrils of wood fed to the refining apparatus be the same and indeed the contemplated refining apparatus as operated is able to exploit this unique characteristic. Theoretical stress analysis verified by direct observation in a scanning electron microscope indicates that the tracheids of southern pine, for example, will fail under torsional stresses when twisted in a clockwise direction about the longitudinal axis of the tracheids and will tend to unwind into highly desirable and conformable ribbon-like fragments. Accordingly, for pulpwood material from trees in which the helix twist of the fibrils is in the Z direction (i.e., southern pine), the rotation of the disks of a refining apparatus must be clockwise as viewed from a position facing the refining surface of the individual disk. For material from trees in which the helix twist of the fibrils is in the S, the direction of the rotation of the disks must be counter-clockwise as viewed from a position facing the refining surface. These ribbon-like fragments, during paper making, provide the cohesive forces essential for developing strength and other desirable characteristics in the finished paper or paper product.

Consider a uniform, smooth-sided, right-cylindrical, intact wood fiber consisting of only the $S_2$ layer. Consider, additionally, that during the late phases of refining the wood fiber becomes radially aligned between the surfaces of the two counter-rotating disks of a conventional double-disk refining apparatus. Absent any substantial amount of slippage, the fiber will rotate about its longitudinal axis at a velocity related to the surface velocities of the opposing disks. However, because the surface velocity of a particular location on a rotating disk depends upon the radial distance of that particular location from disk center, it is plain that the radially distal located end of our radially disposed wood fiber will be forced to rotate more rapidly than will its radially proximal located end. The torsional stress thus set up leads to a shear stress failure of the wood fiber and to some production of finished paper with improved strength characteristics.

In theory, an individual intact fiber becomes radially aligned between counter-rotating disks of the sequential velocity double-disk refiner in the same manner as in a conventional refiner where the fiber rotates in a clockwise direction about its axis and is subjected to the same torsional stress. However, as the rotating fiber moves in a radial direction, it passes the interface of two adjacent and concentric rings, where it is subjected to levels of torsional stress which are higher than those experienced in a conventional double-disk refiner due to the increasing differential rotational velocity of the surface of the rings. At this point, the distal end of the fiber (the end further along the disk radius) is suddenly forced to rotate at a substantially faster rotational velocity than the lower end—a condition favoring higher levels of induced torsional stress and the desired unwinding.

A specific example is set forth below to contrast the efficacy of a sequential velocity disk type refiner with a typical double-disk refiner as operated conventionally.

Southern pine pulp wood chips were partially fiberized by a single pass through a conventional double-disk refiner. This material was refined via the particular apparatus employing the sequential velocity feature with rotational speeds of the sequential concentric rings varied from 420 rpm for the innermost ring to 700 rpm for the outermost (fourth) ring, the rotation of each ring being in the clockwise direction. The ratio of the velocity increase at the interfaces of the several concentric rings was as follows: rings 1 and 2—1.11 to 1; rings 2 and 3—1.25 to 1; rings 3 and 4—1.27 to 1. Clearance between rings was about 0.003 inch.

Simulation of conventional refiner operation was achieved by pinning together all of the concentrically adjacent rings so that they rotated as a single unitary disk. For conventional operation a rotational speed of 562 rpm was selected since this closely approximates the average condition attained when the apparatus was operated utilizing the sequential velocity concept.

Refining surfaces were sandblasted to a roughness equivalent of about 100 grit sandpaper. Clearance between the facing, counter-rotating refining surfaces was controlled at $0.005 \pm 0.002$ inch and the feed rate was nominally 13 g/min (ovendry).

Three refiner runs (replications) were made for each of the two test conditions (with and without sequential velocity). For each, about 1 kg of ovendry fiber was removed from cold storage and placed in a steaming tank. The tank and refining chamber were than steam pressurized (138 kPA); when the temperature in the tank stabilized at about 125° C., the refiner disks and feed screw were activated. A choke valve located in the product eject manifold maintained a pressure drop across the refining zone of about 70 kPA. All runs were for 15 minutes.

Shives were removed from the pulps by means of a laboratory fla-screen with 0.38 mm slots. Handsheets were made from each pulp at nominal basis weights of 60, 70, 80, and 90 g/m$^2$ in accordance with the TAPPI standard method. Five sheet properties were determined-basis weight, density, burst factor, tear factor, and breaking length. Pulp properties measured included Canadian standard freeness, S (in terms of the 48/100 fraction CSF) and L, and the standard Bauer screen classification.

Sheets made from both laboratory pulps were denser and stronger than sheets made from the raw fiber (Table 1). Sheet density was higher and burst factor and breaking length were greater for fiber refined with sequential velocity than for fiber refined without it. By the t-test for unpaired data, these means proved significantly different at the 0.05 level. There was no significant difference between the means observed for tear factor (av. 79.9) or basis weight (av. 78.3).

Pulp properties reflect the higher strengths observed for sheets made from sequential velocity pulp (Table 1). Canadian standard freeness of the raw fiber was 672 ml but was reduced to 172 ml for sequential velocity pulp as compared to 307 ml when sequential velocity was not used. The values obtained for the L factor and the Bauer screen classification reveal a slightly greater reduction of the long fiber fraction for pulps made with sequential velocity than for those made without it. The S value was least for sequential velocity pulp indicating an increase in specific surface. Probably, a proportion of the increase in specific surface can be attributed to greater numbers of unwound tracheids.

Linear regression analysis of the relationship between basis weight and a given sheet property yielded equations of good fit for pulps made with and without sequential velocity and or the raw fiber. For each property, the slope of the relationship was essentially the same for the three types. With these equations, sheet properties were calculated at the more commonly reported basis weight of 60 g/m$^2$ as tabulated below:

| Property | Raw fiber | Without sequential velocity | With sequential velocity |
|---|---|---|---|
| Sheet density, g/cm$^3$ | 0.226 | 0.292 | 0.319 |
| Burst factor | 2.8 | 8.8 | 11.2 |
| Tear factor | 50.2 | 75.1 | 73.4 |
| Breaking length, m | 932.0 | 2060.0 | 2480.0 |

When the properties of the raw fiber are compared to those obtained for sequential velocity pulp, the increases for sheet density, burst, tear, and breaking length were 28.6, 296.4, 46.2, and 166.1 percent, respectively. When sequential velocity was not used, the values were 17.7, 214.3, 49.6, and 121.0 percent.

The screen fractions (R28, 28/48, 48/100, and 100/200) of the raw fiber and pulps made with and without sequential velocity were also examined in a light microscope to provide a visual assessment of fiber characteristics. Four types (intact, frazzled, broomed, and ribbon-strand) were readily identified. Little debris was present in these fractions and was not considered.

Intact fibers were generally well isolated, of varying length, with little or no external cell wall fibrillation. Frazzeled fibers were similar to intact fibers except that external fibrillation of the primary and secondary wall was clearly evident. Broomed fibers exhibited fibrillation or unwinding into ribbon- or strand-like material on one or both ends of a generally intact fiber. Strand material appeared to be derived from broken portions of ribbons and was included in the ribbon group.

Dilute slurries of the fiber fractions from each of two machine replications were examined. The microscope stage was systematically traversed and all fibers passing within the field of view were classified into the types described above. One hundred observations were made for each sample. The average results, expressed as a number percentage, are given in Table 2. Differences between means were tested by variance analysis at the 0.05 level.

For the R28 fraction, the proportion of intact fibers was reduced by both refining methods but was less (av. 61.00 percent) when sequential velocity was used than when it was not (av. 71.33 percent). While the number of frazzled fibers increased for both refining tehniques, there were more frazzled fibers when sequential velocity was used (av. 20.33 percent) than when it was not (av. 13.34 percent). The proportion of broomed fibers was unaffected when the raw fiber was refined without sequential velocity (av. 9.75 percent) but increased to 14.33 percent when sequential velocity was used. There was no significant difference between means for ribbon-strand particles (av. 3.56 percent).

The 28/48 fraction exhibited a similar trend. The proportion of intact fibers was less and the percentage of frazzled and broomed fibers was greater for raw fibers refined with sequential velocity than when refined without sequential velocity. The proportion of ribbons and strands was unaffected by the refining method (av. 12.67 percent).

The 48/100 fraction is of particular interest because it was used for determination of "S" values. For this fraction, the proportion of intact fibers was substantially less when raw fiber was refined with sequential velocity (av. 29.66 percent) than when it was refined without sequential velocity (av. 51.68 percent). The percentage of frazzled and broomed fibers was unaffected by the refining method (av. 8.50 percent and 18.00 percent, respectively).

The proportion of ribbons and strands did not differ from the raw fiber when refined without sequential velocity (av. 24.17 percent) but increased when sequential velocity was used (av. 42.17 percent). Thus, refining with sequential velocity produced a pulp fraction containing a substantially lower proportion of intact fibers and greater numbers of ribbons and strands than when refining without sequential velocity; the proportion of frazzled and broomed fibers was unaffected by the refining method. This result would be expected to yield a fraction of higher specific surface and is in agreement with the trends observed for "S" values.

The 100/200 fraction exhibited the same trends as the 48/100 fraction. Fiber refined with sequential velocity produced a pulp containing a lower proportion of intact fibers and greater numbers of ribbons and strands than when refining without sequential velocity while the proportion of frazzled and broomed fibers was unaffected by the refining method.

Table 1.

Handsheet properties and pulp characteristics of raw fiber and pulp made with and without sequential velocity

| Property | Raw fiber | Without sequential velocity[1] | With sequential velocity[1] |
|---|---|---|---|
| Basis weight, g/m$^2$ | 81.7 | 80.2 | 76.4 |
| Density, g/cm$^3$ | 0.238 | 0.308 | 0.334 |
| Burst factor | 3.7 | 10.1 | 12.4 |
| Tear factor | 58.6 | 80.5 | 79.2 |
| Breaking length, m | 1005 | 2164 | 2580 |
| Canadian standard freeness, ml | 672 | 307 | 172 |
| S-factor, ml | 724 | 673 | 642 |
| L-factor, percent | 68.9 | 59.7 | 52.3 |
| Bauer screen classificaton, percent | | | |
| R28 | 46.3 | 36.1 | 28.2 |
| 28.48 | 22.6 | 23.6 | 24.0 |
| 48/100 | 6.1 | 7.3 | 8.5 |

Table 1.-continued

| Handsheet properties and pulp characteristics of raw fiber and pulp made with and without sequential velocity | | | |
|---|---|---|---|
| Property | Raw fiber | Without sequential velocity[1] | With sequential velocity[1] |
| 100/200 | 3.4 | 5.4 | 6.1 |
| 2200 | 21.6 | 27.6 | 33.2 |

[1]Values are means of the three refiner replications.

Table 2.

| Number percentage of fiber types in screen fractions for raw fiber and pulps made with and without sequential velocity | | | | | | | | | | | | |
|---|---|---|---|---|---|---|---|---|---|---|---|---|
| | Bauer fracton | | | | | | | | | | | |
| | | R28 | | | 28/48 | | | 48/100 | | | 100/200 | |
| Fiber types | Raw fiber | Without sequential velocity | With sequential velocity | Raw fiber | Without sequential velocity | With sequential velocity | Raw fiber | Without sequential velocity | With sequential velocity | Raw fiber | Without sequential velocity | With sequential velocity |
| | Percent | | | | | | | | | | | |
| Intact | 81.00 | 71.33 | 61.00 | 77.17 | 58.33 | 43.66 | 58.67 | 51.67 | 29.66 | 26.33 | 21.00 | 11.83 |
| Frazzled | 8.50 | 13.34 | 20.33 | 4.50 | 13.67 | 19.67 | 2.50 | 7.16 | 9.84 | 0.00 | 2.83 | 2.17 |
| Broomed | 9.00 | 10.50 | 14.33 | 11.17 | 16.67 | 22.67 | 14.00 | 17.67 | 18.33 | 5.50 | 6.50 | 5.33 |
| Ribbon-strand | 1.50 | 4.83 | 4.34 | 7.16 | 11.33 | 14.00 | 24.83 | 23.50 | 42.17 | 68.17 | 69.67 | 80.67 |

Having described our invention, what We claim is:

1. In a double-disk refining apparatus having counter-rotating disks for refining wood fibers the improvement wherein each disk comprises a plurality of concentric rotatable rings, said rings being attached to rotating means for independently rotating said rings.

2. The apparatus of claim 1 wherein the rotating means is attached to the rings in a manner such that each ring, beginning with the innermost ring, rotates at sequentially increasing rotational velocities.

3. The apparatus of claims 1 or 2 wherein the plurality of rings are in the form of a plurality of nested cylinders having the rotating means attached at one end of said cylinders, the other end forming a refining surface.

4. The apparatus of claims 1 or 2 wherein the plurality of rings may be rotated in the clockwise direction.

5. The apparatus of claims 1 or 2 wherein the plurality of rings may be rotated in the counter-clockwise direction.

* * * * *